United States Patent [19]

Reiner et al.

[11] 4,023,705

[45] May 17, 1977

[54] DISPENSER FOR CARDS AND THE LIKE

[75] Inventors: Lawrence L. Reiner, Woodbury, N.Y.; John P. McNett, Short Hills, N.J.

[73] Assignee: Lawrence L. Reiner, Woodbury, N.Y.

[22] Filed: Apr. 10, 1975

[21] Appl. No.: 566,808

[52] U.S. Cl. ..... 221/186; 221/256; 221/194; 221/193

[51] Int. Cl.[2] ..... A24F 15/04

[58] Field of Search ..... 221/256, 186, 232, 191, 221/193, 194, 266; 273/149 R

[56] References Cited

UNITED STATES PATENTS

| | | | |
|---|---|---|---|
| 324,717 | 8/1885 | Meyers | 221/256 X |
| 1,678,281 | 7/1928 | Cole | 221/186 |
| 2,321,570 | 6/1943 | Billing | 221/256 X |
| 3,549,047 | 12/1970 | Radtke | 221/186 X |

*Primary Examiner*—Allen N. Knowles
*Attorney, Agent, or Firm*—Edward F. Levy

[57] ABSTRACT

Card dispenser for participating games involving an element of chance sequentially dispenses a stack of random cards placed into the device. The dispenser includes a hopper having a dispensing opening and a track divided by uniformly spaced upwardly directed transverse ribs into a series of adjacent co-planar card receiving surfaces. Elongate guide members on the track and mating channels on downwardly depending skirts on the hopper permit the hopper to move relatively to and along the track to bring the dispensing opening into registry with successive ones of the card receiving surfaces, the hopper advancing the lowermost cards in the stack until deposited on a surface while the transverse ribs prevent movement of the deposited cards in the direction of hopper movement and therefore retain the cards in the deposited positions thereof.

16 Claims, 7 Drawing Figures

DISPENSER FOR CARDS AND THE LIKE

BACKGROUND OF THE INVENTION

The present invention generally relates to dispensers, and more specifically to dispensers for cards or the like which are capable of dispensing a plurality of cards or the like adjacently to one another along a track in a simple and convenient manner.

While numerous care dispensers are known in the art, most of these are merely intended to receive a stack of cards therein while exposing an end card of the stack for facilitating removal of the same from the device. However, most prior art card dispensers are merely designed for facilitating removal of the end card and for preventing the manipulation of cards in a stack to prevent, to the extend possible, the reduction of the element of chance in the game. To this end, most prior art card dispensers provide a slot through which the end card may be withdrawn, usually by manual action of the dealer. However, while such card dispensers are useful for many card games, there are numerous games of chance and otherwise which make it desirable to dispense a series of cards simultaneously or substantially simultaneously. The prior art devices are not suitable for this purpose and, accordingly, are suitable for manually dispensing one card at a time as opposed to sealing plurality of cards sequentially.

SUMMARY OF THE INVENTION

Accordingly, it is object of the present invention to provide a card dispenser which does not hve the above-described disadvantages associated with comparable prior art dispensers.

It is another object of the present invention to provide a card dispenser which is simple in construction and economical to manufacture.

It is still another object of the present invention to provide a card dispenser which is suitable for dealing a plurality of cards from a stack sequentially so that a predetermined number of cards may be dealt simultaneously or substantially simultaneously in a simple and convenient manner.

It is yet another object of the present invention to provide a card dispenser of the type suggested above which can semi-automatically dispense a predetermined number of cards stored in a hopper on to a track by relative movement of the hopper with respect to the track.

It is a further object of the present invention to provide a card dispenser of the type under discussion which facilitates playing of games, such as of chance, which require a predetermined number of items of information by dispensing sequentially a corresponding predetermined number of objects bearing the required information.

It is still a further object of the present invention to provide a card dispenser of the type mentioned in the above object, which permits rapid loading thereof with a stack of random cards and simple and convenient dispensation of a desired number of cards from one end of the stack.

It is yet a further object of the present invention to provide a dispenser which is suitable for dispensing planar objects of any desired configuration on to a track in a predetermined sequence depending upon the sequence of the objects when placed into the dispenser.

Accordingly, placing the objects in a random sequence within the dispenser results in information, provided on the objects, to be similarly randomly dispensed.

In order to achieve the above objects, as well as others which will become apparent hereafter, the device for successively dispensing a flat information-bearing object from one end of the stack of such equally sized objects each having a predetermined thickness, includes hopper means having a dispensing opening and internal dimensions to substantially correspond to the planar configuration of the object to permit the end objects of the stack disposed within said hopper means to successively pass therethrough with clearance. An elongate object receiving track which includes a plurality of in-line adjacently disposed object-receiving means includes wall portions substantially transverse to the in-line direction of said track which define a depth equal to approximately said predetermined thickness and dimensioned to receive only a single object therein. In this manner, relative movement of the hopper means with respect to the track to positions to bring the dispensing opening into registry with one of the object-receiving means causes an end object of the stack to drop out of said opening and into a respective object-receiving means. Furthermore, movement of said hopper means over successive ones of a series of adjacent object-receiving means causes a corresponding number of end-objects of the stack to drop into the respective object-receiving means with which said opening is brought into registry. The cards received within said object-receiving means are thereby inhibited from inadvertently leaving the same by the retaining action of said transverse wall portions.

BRIEF DESCRIPTION OF THE DRAWINGS

The foregoing, as well as other objects of the present dispenser will best be understood from the following detailed description of the preferred embodiment with reference to the drawings, wherein.

DESCRIPTION OF THE PREFERRED EMBODIMENTS

Figures 1, 2, 5, 6, 7:
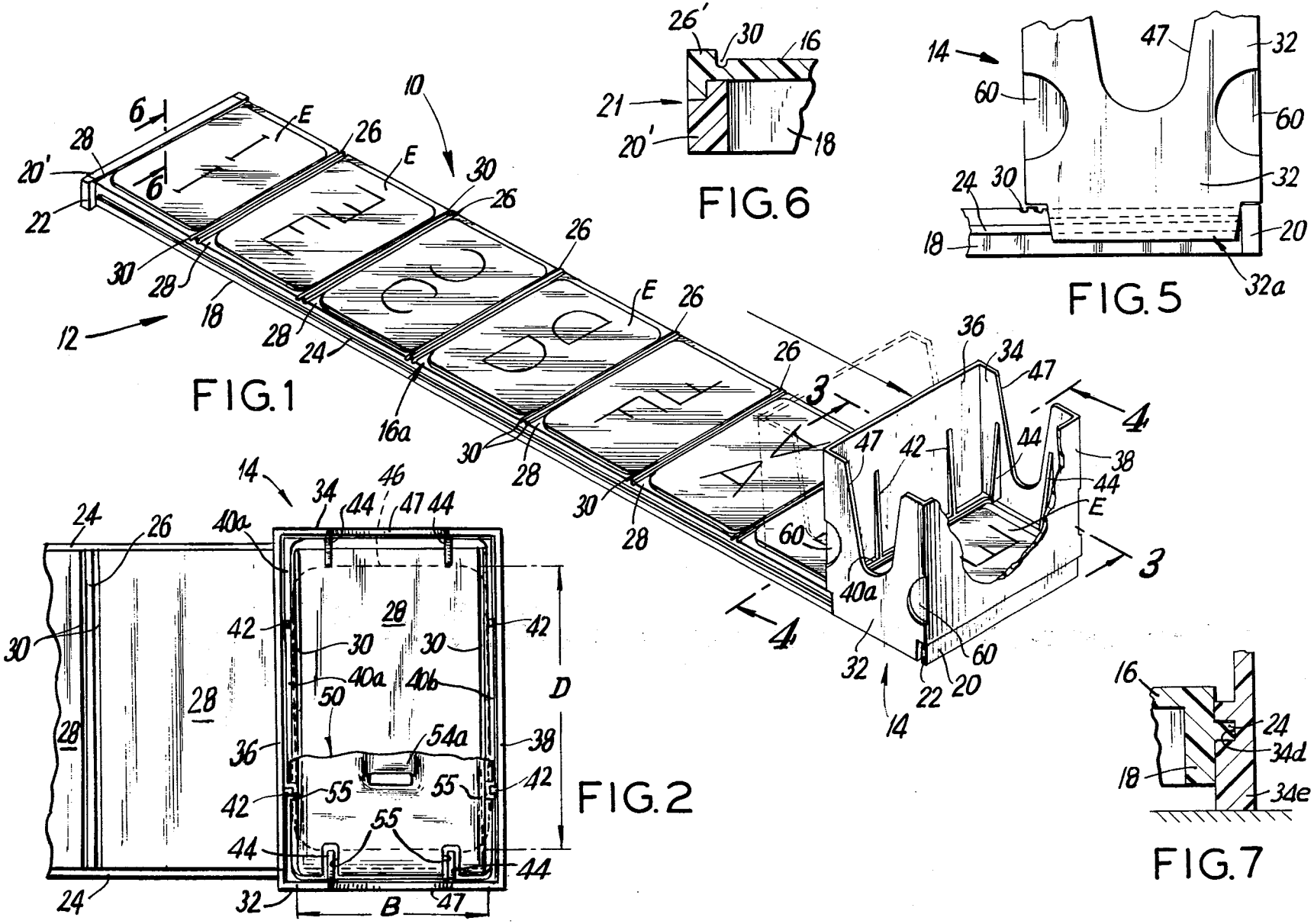
FIG. 1 is a perspective view of a card dispenser in accordance with the present invention, showing the hopper partially broken away to expose some of the internal construction thereof, and further showing in phantom outline a second position of the hopper as the latter moves from one end of the track towards the other end thereof.
FIG. 2 is a fragmented top plan view of the track and the hopper as shown in FIG. 1, and showing in dashed outline the effective dispensing opening defined by the tapered ribs formed on the inside surfaces of the hopper walls.
FIG. 5 is a fragmented side elevational view of the hopper and the track shown in FIG. 1.
FIG. 6 is a partial cross-section of the track taken along line 6—6 in FIG. 1, showing the manner in which the track is assembled at one end thereof for facilitating manufacture of the dispenser.
FIG. 7 is a partial cross-section similar to FIG. 4, but showing a further embodiment of the invention wherein the skirt of the hopper extends below the legs or lateral walls of the track to permit movement of the track relative to the stationary hopper, while in the embodiment shown in the rest of the figures, the track generally rests upon a surface and it is the hopper which is moved relative to the stationary track.

Referring now to the Figures, in which identical or similar parts are designated by the same reference numerals throughout, the card dispenser in accordance with the present invention is generally designated in FIG. 1 by the reference numeral 10.

The card dispenser 10 includes two basic operative parts or elements. The first is a track 12 which is shown to be in the nature of a base which may rest, for example, on a table. The other element of the dispenser 10 is generally designated by the reference numeral 14 and is in the form of a hopper or feeder which is suitable for receiving a stack of cards and, as to be described below, rides on or can be moved relative to the track 12 to sequentially deposit the end-most cards on to the track in the same order in which they were placed into the hopper 14.

Figure 4:
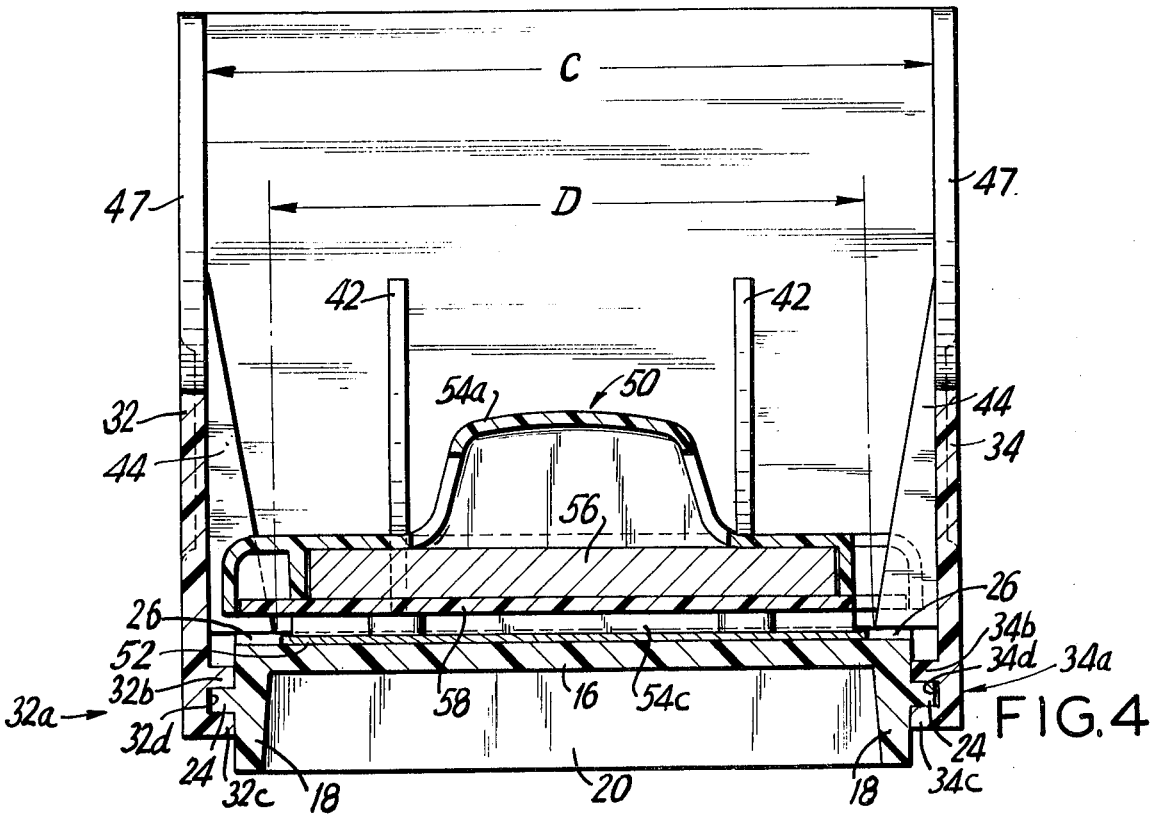
FIG. 4 is a cross-sectional view of the hopper and the track shown in FIG. 1, taken along line 4—4, and showing the weight which is receivable within the hopper for assuring advancement of the cards through the dispensing opening of the hopper.

Referring to FIGS. 1 and 4, the track 12 includes a top wall 16 and lateral walls or legs 18 which downwardly depend from the top wall 16. End walls or pieces 20, 20' are provided at the opposing ends of the track 12 and serve as gates or stops which prevent movement of the hopper off the track. One of the end walls 20, 20' is advantageously integrally formed with the top wall 16 and lateral walls 18, while the other of the end pieces or walls 20, 20' is initially separately formed to facilitate mounting of the hopper 14 on to the track. A suitable butt joint 21, as shown in FIG. 6, may be utilized to fixedly connect the end wall 20' to the top walls 16 and lateral walls 18 of the track 12. Any suitable adhesive may be utilized for this purpose and, when the track is made from a synthetic plastic material, sonic-sealing techniques may be utilized to form the joint.

Each of the end pieces 20, 20' include projecting portions 22 which extend beyond the lateral walls 18 to form stops which are suitable for engaging the lower surface portions of the hopper 14 and preventing the hopper from moving off the track as suggested above.

For reasons to be described hereafter, the spaced position and orientation of the hopper 14 relative to the track 12 is important and must be maintained at all positions of the hopper on the track. For this purpose, there is provided guide means for guiding the hopper along the track while maintaining the relative positions and orientations of the hopper substantially fixed relative to the track. One element of such guide means is an elongate vertical guide projection or member 24 which projects outwardly as shown in FIG. 1 and extends substantially along the entire length of the track 12. In this connection, it is pointed out that the top wall 16 exhibits an upper substantially flat surface 16*a*, and, for the reasons which will become evident hereafter, the elongate guide members 24 are advantageously disposed parallel and maintained parallel to the upper surface of the top wall 16 along the length of the track. Stated otherwise, the vertical guide members 24 are substantially uniformly spaced from the top surface 16*a* along the entire length of the track 12.

A plurality of uniformly spaced transverse ribs 26 project above the surface 16*a* of the top wall 16 to define a series of adjacent co-planar surfaces 28, each of which is approximately dimensioned to correspond to the planar dimensions of the cards "E", whereby a card E may be deposited on and substantially cover each of the surfaces 28. With the cards E having a predetermined thickness, it is desirable that the ribs 26 project above the surfaces 28 a distance sufficient to engage the cards E and stop or prevent the cards from slideably moving on its associated surface beyond or over the rib on to an adjacent surface 28. To this end, it is presently contemplated that the ribs 26 extend a distance above the surfaces 28 which is at least approximately 50 percent of the predetermined thickness of the cards E. The precise distance which the ribs 26 extend above the surfaces 28 is to a great extent a function of the dimensional stability of the material from which the cards E are made. For example, if the cards are made from cardboard, it may be necessary to increase the height of the ribs 26 to approximately 80 percent of the height of the cards to assure proper stopping or retaining action of the ribs 26 due to possible variations in thickness of the cards due to drying, warping, absorption of moisture, and the tolerances of commercially available cardboard. For this reason, cards made from cardboard can be termed to lack dimensional stability or dimensional memory. However, cards made from plastic, for example, have good dimensional stability or memory. When the predetermined thickness of all the cards E is and remains relatively constant, it is possible to project the ribs 26 almost the predetermined thickness of the cards. However, the projection of the ribs 26 above the surfaces 28 is advantageously not more than 80 percent of the nominal card thicknesses when the materials from which the cards are made are not dimensionally stable. The reason for this is to prevent the situation where two cards, each of which may be as little as one half the nominal thickness, are deposited on a single planar surface and retained by an excessively high rib.

To ensure retaining action by the ribs 26, there is advantageously provided between each rib 26 and associated surface 28 a groove 30 which extends across the width of the track 12, as best shown in FIG. 2. The grooves 30 prevent accumulation of dirt, dust and other contaminants, which accumulations at the points where the ribs 26 join the surfaces 28 would effectively reduce the heights of the ribs and thereby impair the stopping or retaining action thereof.

The card holder or shuffler, in the nature of a hopper or feeder 14, is a rectangular enclosure having opposing parallel front and rear walls 32, 34 respectively and opposing side walls 36, 38. The reference to the positions of these walls is only for purposes of description and is not intended to limit the structure in any manner whatsoever. The aforementioned walls of the hopper 14 define a hollow rectangular enclosure having an upper and lower open ends, the top opening being suitable for receiving a stack of cards and a bottom opening for dispensing the cards in a manner to be described hereafter.

Figure 3:
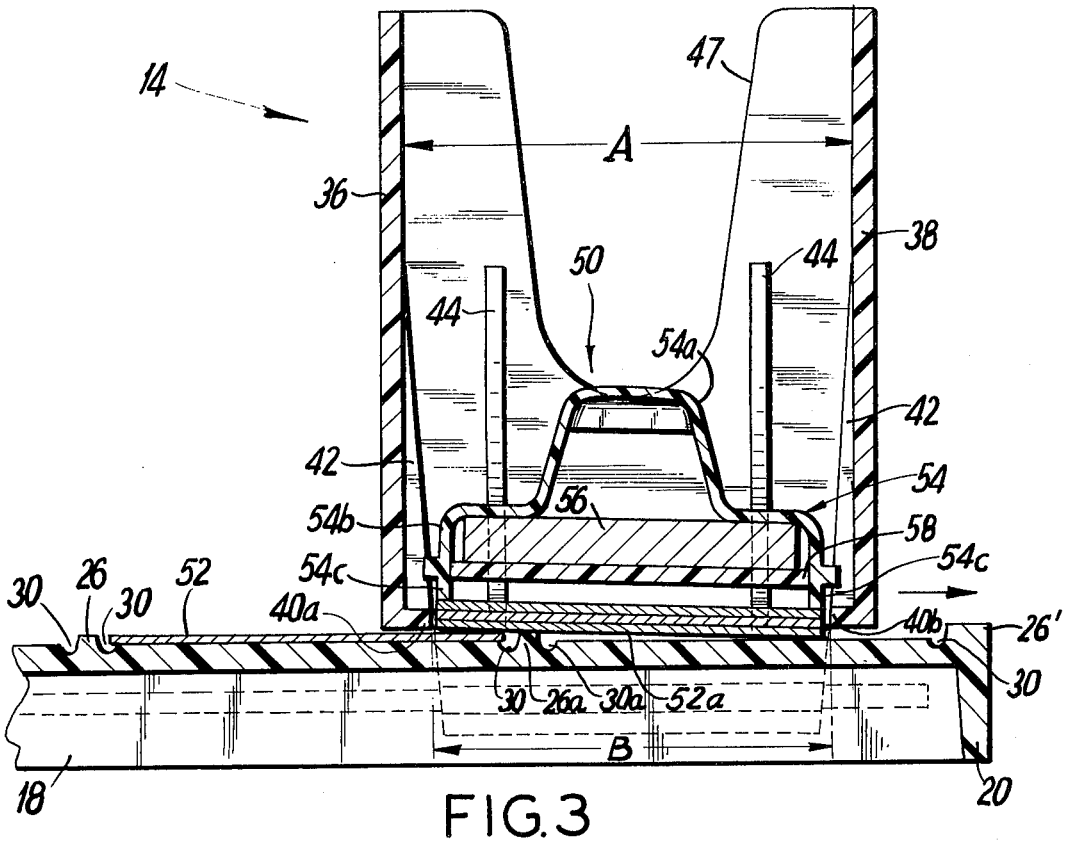
FIG. 3 is a partial cross section of the hopper and track shown in FIG. 1, taken along line 3—3, further showing a weight disposed within the hopper resting upon a stack of cards and the manner in which the end cards of the stack are successively deposited on to adjacent co-planar surfaces of the track with movement of the hopper relative to the track.

Referring to FIG. 3, the side walls 36, 38 are provided with inwardly directed lower ridges or lips 40*a*, 40*b* respectively. The inner surfaces of the side walls 36, 38 are spaced a distance "A" and the lower lips 40*a*, 40*b* have the opposing edges spaced a distance "B" which is smaller than the distance A. Also referring to FIG. 2, it will be noted that the lower lips 40*a*, 40*b* define the width dimension of the lower or dispensing opening of the hopper 14. The purpose of making the dimension A larger than the dimension B is to primarily provide sufficient clearance with facilitates the insertion of the stack of cards through the top or upper opening of the hopper 14.

Each of the side walls 36, 38 is provided on the inner surfaces with vertical tapered guide ribs 42 as best shown in FIG. 3 which have increasing dimensions as shown from an intermediate height along the side walls to a dimension which is substantially equal to the projected distance of the lower lips 40*a*, 40*b*. Advantageously, the ribs 42 smoothly merge with the lower lips at the points where they join so as to provide continuous guiding surfaces for the cards, which ribs smoothly and continuously feed the cards from the interior of the housing or hopper 14 and centrally align the cards to assure free passage through the dispensing opening or between the lower lips 40*a*, 40*b*.

For reason to be described below, as well as for the purpose of providing sufficient clearance for initial insertion of the stack of cards into the hopper 14 as suggested above, the front and rear walls 32, 34 are similarly spaced from one another a distance greater than the corresponding dimension of the cards which are received therebetween. For this reason, vertical tapered guide ribs 44 are provided on each of these walls, which tapered ribs similarly increase in dimension from an intermediate height along the walls 32, 34 to a final or ultimate dimension which corresponds to one of the planar dimensions of the cards which are to be dispensed. Accordingly, it will become clear that the lower lips 40*a*, 40*b*, together with the tapered ribs 42, and the tapered ribs 44 together define in the plane of the lower lips 40*a*, 40*b* an effective dispensing opening 46 which is shown in dashed outline in FIG. 2. The effective dispensing opening 46 is advantageously somewhat greater in both planar dimensions than the corresponding dimensions of the cards so as to provide some clearance between the cards and the ribs 42, 44 and the lower lips 40*a*, 40*b* so as to permit the cards E to freely pass through the opening 46 under the weight of gravity.

To further facilitate the insertion of a stack of cards into the hopper 14, there is advantageously provided cut-outs 47 as shown which open at the upper edges of the front and rear walls 32, 34 and extend a distance which is advantageously greater than the cumulative thickness of the stack of cards which are to be inserted into the hopper 14. The cut-outs 47 permit a person to insert the stack of card by holding the edges of the equally sized cards even after the same are substantially received within the four walls of the hopper. By maintaining a grip on the cards and keeping them aligned in substantially horizontal positions until the stack of cards is substantially received within the hopper 14, tipping of the cards is substantially prevented which may otherwise cause the cards to stick within the hopper and prevent free downward movement thereof through the dispensing opening 46.

Referring particularly to FIG. 4, it is noted that the effective opening dimension "D" is smaller than the spacing "C" of the inside surfaces of the walls 32, 34, as suggested above. Aside from increasing the spacing between the side surfaces of the walls 32, 34 of the hopper to provide additional clearance to facilitate insertion of a stack of cards as discussed above, the walls 32, 34 are spaced sufficiently apart so as to permit the lower ends thereof, in the form of skirt portions 32*a*, 32*b* respectively, to position the skirt 32*a* in front of the associated lateral wall 18 and the skirt 34*a* in back of the associated lateral wall 18 as shown. The skirt 32*a* has an upper elongate inwardly directed projection 32*b* and a lower similar projection 32*c*, the projections 32*b* and 32*c* together forming a channel 32*d* which is dimensioned to receive the vertical guide projection or member 24 on the track 12. Similarly, the projections 34*b* and 34*c* of the skirt 34*a* together define a channel 34*d* which receives an associated guide member 24.

The skirts 32*a* and 34*a* are so arranged with respect to the guide projections 24 so as to maintain the lower lips or ridges 40*a*, 40*b* of the hopper 14 housing at a height above the surfaces 28 which is approximately equal to the nominal or predetermined thicknesses of the cards. Clearly, the hopper housing must be maintained at a sufficient distance above the track 12 so as to clear the transverse ribs 26 as the hopper 14 is slideably moved along the guide member 24 from one end of the track to the other. For example, by maintaining the lowermost surfaces of the ridges 40*a*, 40*b* a distance equal to the nominal distance above the track 12 and having the projections or ribs 26 project upwardly a distance approximately 80 percent of the nominal card thickness, satisfactory operation of the device 10 has been obtained.

In the presently preferred embodiment, the lateral walls 18 of the track 12 extend below the skirts 32*a*, 34*a* of the hopper as best shown in FIG. 4. With such an arrangement, the track 12 may rest upon the legs or lateral walls 18 upon a surface such as a table. In such an instance, the hopper 14 is reciprocally moved from one end of the track 12 to the other while the track itself may be maintained stationary. For reasons which will become apparent hereafter, it is the relative movement between the hopper 14 and the track 12 which is of importance. Accordingly, there is shown in FIG. 7 a modification of the preferred embodiment, wherein the skirts of the hopper extend below the lateral walls or legs of the track 12. In such an instance, the device rests upon the lower ends of the hopper 14. With such an arrangement, it is the track 12 which is freely moveable relative to the stationary hopper. While the same advantages may be obtained as with the preferred embodiment, the modified version is not as stable during use since the width of the skirts are substantially less than the lengths of the lateral walls 18. One possible way for compensating for this effect could be to enlarge the widths of the skirts in the modified version to thereby somewhat improve the stability.

Referring to FIG. 4, there is shown a weight generally designated by reference numeral 50, resting upon a card 52 which has been deposited on to the top wall 16. As described above, the cards are permitted to freely drop through the opening 46 under the action of their own weight due to gravity. However, a weight 50 is advantageously utilized which is itself freely moveable between the upper and lower openings of the hopper 14, which weight applies an additional downward force on the stack of cards to ensure that the cards advance through the dispensing opening of the hopper. The precise nature of the weight 50 is not critical and any weight which is deposited on top of the stack of cards may be used for this purpose. In the presently preferred embodiment, the weight 50 includes a hollow casing 54, which may be formed out of aluminum, which casing has a gripping upper portion 54*a* and lower spaced walls 54*b* having lower edges 54*c*. Disposed within the casing 54 is a weight 56, such as a slab of heavy metallic substance. A bottom retaining plate 58 is provided which is connected to the casing in any conventional manner and serves to retain the weight 56 within the casing.

The casing 54 is advantageously provided with vertical slots 55 at all the peripheral sides thereof which are positioned and dimensioned to receive the tapered guide ribs 42 and 44, even at the lowermost positions of the weight 50 as shown in FIGS. 3 and 4, so that the weight may freely move between the upper and lower openings without interference of the tapered guide ribs.

The operation of the card dispensing device will now be described. With the hopper 14 typically at one end of the track 12, such as shown in FIG. 1, a stack of equally sized planar cards is deposited within the hopper housing by guiding the same through the cut-outs 47 and dropping the stack, to be further guided by the tapered ribs 42, 44 to thereby bring the lowermost end part of the stack between the lips or ridges 40*a*, 40*b* within the effective dispensing opening 46 as determined by the ribs 42, 44. The housing or hopper 14 is then slidably moved along the guide member or rail 24 to bring the dispensing opening 46 into registry or in opposition with successive or adjacent surfaces 28. Each surface 28 together with the ribs 26, or with respect to the end surfaces 28, with the ribs 26', together form a card-receiving means for receiving an individual card. When the opening 46 is brought into registry with one of the card-receiving means, as shown in FIG. 2, the end card E is permitted to drop on to the surface 28. Referring to FIG. 3, with a card 52 having been deposited as shown, and with the hopper 14 moving towards the right, the next successive end card 52*a* in the stack is initially maintained at the level of the lower lips 40*a*, 40*b* and maintained at the dispensing end by the previously deposited card 52. The card 52*a* at the dispensing end is caused to slideably move, in the example of FIG. 3, by the lip 40*a* over the previously deposited card 52 into the proximity of the next adjacent card-receiving means and over the intermediate rib 26*a* between the two surfaces until the hopper is brought into registry with the next adjacent surface. In FIG. 3, the hopper 14 is shown sufficiently advanced over the next adjacent surface to thereby result in the bottom-most card 52*a* to start dropping at the leading edge thereof and thereby tip over onto the next card-receiving means while still being advanced onto the same by the lower lip 40*a*.

With a stack of cards disposed within the hopper 14, it should be clear from the above description that the stack of cards can be sequentially dispensed in the same order as the cards are placed into the hopper. Clearly, when cards bearing intelligence or information are randomly arranged within the hopper 14, the device will be effective for randomly dispensing information on to the track 12. For this reason, the device 10 is suitable for use with any of a number of participation games of chance.

While the above device 10 has been described as being particularly suitable for planar rectangular cards, it should be clear that with the above teachings a person skilled in the art can easily adapt the configuration of the track 12, the ribs 26 and the hopper 14, to dispense any planar object having desired peripheral configurations. In each case, the surfaces 28 as well as the internal dimensions of the hopper 14 are advantageously selected to correspond to the peripheral shape of the planar objects. The ribs 26 need not, in any case, extend continuously across the track 12 but may comprise any suitable protuberance means which project above the planar surfaces 28 and which are adapted to engage at least a peripheral portion of the planar objects once these have been deposited onto the track 12. Of importance in each instance is that the planar objects be permitted to freely move through the hopper 14 and through the dispensing opening 46, in whatever shape the latter may be. Once the stack of objects are in the hopper, it is important to note that the lowermost object in the stack is primarily influenced by the lower lips or ridges 40*a*, 40*b*. However, after a lowermost planar object has dropped on to a corresponding surface, the planar object is no longer under the control of the hopper 14 but its position is maintained and the object is prevented from slideably moving off the surface on which it was deposited by the action of the retaining ribs 26, or, more generally, the movement limiting means which project upwardly on the track 12.

Based on the above, the device 10 of the present invention can be utilized to sequentially dispense or deal cards, chips of any desired shape or the like. The thicker the planar objects are which are to be dispensed, obviously the less critical the heights of the ribs 26 above the surfaces 28 or the distances of the lower lip 40*a*, 40*b* above the surfaces. However, use of relatively thick planar objects permits dispensing only a relatively small number of such objects within a moderately sized hopper 14. However, there is no limit, within practical considerations, for the height of the hopper and the number of planar objects in a stack which may be placed thereinto to be dispensed during successive reciprocations of the hopper 14 along the track 12.

Also, while a straight track 12 has been described, it should be clear that the track may be made arcuate, circular, or any other configuration so long as the hopper 14 can be freely slidably moved thereon over the length thereof, and maintained positioned and oriented as described above over the entire track.

While the presently preferred embodiment for the present invention has been disclosed and described here in detail, it will be understood that numerous modifications may be resorted to without departing from the scope of the invention as defined in the following claims.

I claim:

1. Device for successively dispensing flat cards from one end of a stack of equally sized cards each having a predetermined thickness, comprising hopper means having a dispensing opening and internal dimensions to substantially correspond to the planar configuration of the cards and to perit the end cards of a stack disposed within said hopper means to successively pass therethrough with clearance; an elongate card receiving track which includes a plurality of in-line adjacently disposed card-receiving means including wall portions substantially transverse to the in-line direction of said track and which define a depth equal to approximately said predetermined thickness and dimensioned to receive only a single card therein, whereby relative movement of said hopper means with respect to said track to positions to bring said dispensing opening into registry with one of said card-receiving means causes an end card of a stack to drop out of said opening and into a respective card-receiving means, and whereby movement of said hopper means over successive ones of a series of adjacent card-receiving means causes a corresponding number of end-cards of the stack to drop into the respective card-receiving means with which said opening is brought into registry, the cards received within said card-receiving means being inhibited from inadvertently leaving the same by the retaining action of said transverse wall portions, said track having an upper surface and said wall portions being spaced from each other along said upper surface to define a plurality of in-line co-planar surfaces, and further comprising a groove in each co-planar surface parallel to and adjacent to an associated wall portion, whereby said grooves do not permit accumulation to form at said wall portions which may effectively reduce the heights of said wall portions substantially below said predetermined thickness.

2. Device as defined in claim 1, wherein the cards are rectangular and wherein said hopper means comprises a rectangular housing having two pairs of opposing parallel walls and being open at opposite ends, one of said open ends forming said dispensing opening and other end forming an opening for filling or inserting the cards into said housing.

3. Device as defined in claim 2, wherein said track is horizontally disposed, and said two pairs of opposing parallel walls are vertically disposed, said filling and dispensing open ends being substantially vertically aligned during use of the device, whereby the cards can freely pass through said housing and said dispensing opening under their own weight due to gravity.

4. Device as defined in claim 3, further comprising weight means freely movable between said open ends and suitable for placing on a stack of cards within said housing, whereby advancement of the cards through said dispensing opening is assured when cards are dispensed from said housing by movement thereof relative to said track.

5. Device as defined in claim 1, whereby said track has an upper surface and whereby said wall portions project above the upper surface of said track a distance at least 50 percent of said predetermined thickness.

6. Device as defined in claim 1, wherein said track is straight and said wall portions comprise ribs uniformly spaced along said track and extending transversely to the direction of said track to define said plurality of co-planar surfaces, said ribs projecting upwardly therefrom to define with said co-planar surfces said card-receiving means.

7. A device as defined in claim 2, wherein said housing is mounted on said track for reciprocal movement in a direction along the latter, said housing having one of said pair of opposing parallel walls substantially parallel to said directions, said one pair of walls each being provided with inwardly facing recesses suitable for gripping by a finger of the user while moving the same along said track.

8. Device as defined in claim 1, further comprising stop means at the ends of said track for preventing movement of said hopper means off said track during reciprocal movements thereon.

9. Device for successively dispensing rectangular flat cards from one end of a stack of equally sized cards each having a predetermined thickness, comprising hopper means having a dispensing opening and internal dimensions to substantially correspond to the planar configuration of the cards and to permit the end cards of a stack disposed within said hopper means to successively pass therethrough with clearance, said hopper means comprising a rectangular housing having two pairs of opposing parallel walls and being open at opposite ends, one of said open ends forming said dispensing opening and the other end forming an opening for filling or inserting the cards into said housing; an elongate cardreceiving track which includes a plurality of in-line adjacently disposed card-receiving means including wall portions substantially transverse to the in-line direction of said track and which define a depth equal to approximately said predetermined thickness and dimensioned to receive only a single card therein, said track being horizontally disposed, and said two pairs of opposing parallel walls being vertically disposed, said filling and dispensing open ends being substantially vertically aligned during use of the device, whereby the cards can freely pass through said housing and said dispensing opening under their own weight due to gravity and said two pairs of opposing parallel walls being respectively spaced from each other distances greater that the corresponding dimensions of the cards, and tapered vertical guides on said parallel walls increasing in dimensions from said filling towards said dispensing openings, whereby the effective opening at said filling end is larger than the size of the cards to facilitate insertion of the cards into said housing, and the effective opening at said dispensing end is substantially equal to that of the cards to permit passage of the cards therethrough with clearances, whereby said guides advance the cards through and align the same at said dispensing opening to assure accurate placement of the cards within said card-receiving means.

10. A device as defined in claim 9, wherein said housing is reciprocally movable along said track along a direction normal to one pair of said opposing parallel walls, said one pair of opposing walls being provided at the lower ends thereof with inwardly directed lips spaced from each other to substantially correspond to one dimension of the cards, whereby movement of said housing along said direction causes said lips to engage the lowermost cards in the stack until the same are deposited within a card-receiving means.

11. Device for successively dispensing rectangular flat cards from one end of a stack of equally sized cards each having a predetermined thickness, comprising hopper means having a dispensing opening and internal dimensions to substantially correspond to the planar configuration of the cards and to permit the end cards of a stack disposed within said hopper means to successively pass therethrough with clearance, said hopper means comprising a rectangular housing having two pairs of opposing parallel walls and being open at opposite ends, one of said open ends forming said dispensing opening and the other end forming an opening for filling or inserting the cards into said housing; an elongate card-receiving track which includes a plurality of in-line adjacently disposed card-receiving means including wall portions substantially transverse to the in-line direction of said track and which define a depth equal to approximately said predetermined thickness and dimensioned to receive only a single card therein, whereby relative movement of said hopper means with respect to said track to positions to bring said dispensing opening into registry with one of said card-receiving means causes an end card of a stack to drop out of said opening and into a respective card-receiving means, and whereby movement of said hopper means over successive ones of a series of adjacent card-receiving means causes a corresponding number of end cards of the stack to drop into the respective card-receiving means with which said opening is brought into registry, the cards received within said card-receiving means being inhibited from inadvertently leaving the same by the retaining action of said transverse wall portions, said housing being mounted for reciprocal movement in a direction along the latter, said housing having one of said pair of opposing parallel walls substantially parallel to said direction, said one pair of walls being provided with an elongate cutout opening at an end of said housing remote from said dispensing opening, whereby said cutout is suitable for maintaining a grip of a stack of cards during insertion of the same into said housing when the stack is partially inserted therein to assure proper alignment of the cards for subsequent dispensing.

12. Device for dispensing equally sized planar cards having a predetermined thickness comprising hopper means having an open card-dispensing end, the internal dimensions of said hopper means substantially corresponding to the planar dimensions of the cards to permit a stack of cards to pass through said hopper means with clearance; an elongate track having a plurality of co-planar surfaces arranged in series along the length of said track and each of which has dimensions substantially equal to the dimensions of said dispensing end; guide means for guiding said hopper means for relative movement along said track to cause said dispensing end to register with successive ones of said surfaces, said guide means further maintaining said dispensing end spaced from said surfaces a distance approximately equal to said predetermined thickness and protuberance means between adjacent track surfaces and projecting beyond said surfaces a distance approximately equal to said predetermined thickness to define movement limiting means and, with associated surfaces, card-receiving means, whereby only the end card of a stack at said dispensing end can be received; each card-receiving means on said track when said housing is in opposition or in registry with the respective card-receiving means and the next successive card in the stack is thereby maintained at said dispensing end until said housing is brought into registry with the next successive card-receiving means, said track having a pair of spaced downwardly depending walls extending along the length thereof, and said guide means comprising an elongate outwardly projecting guide member as each of said spaced walls, and said hopper means including two spaced walls each provided at the lower ends thereof with elongate inwardly facing guide channels matingly receiving an associated guide member, whereby said hopper means can be slidably moved relative to said track by slidably moving said guide members through said channels.

13. Device as defined in claim 12, wherein said spaced walls of said track extend below the ends of said spaced walls of said hopper means, whereby the device may be rested on a surface on said track spaced walls and said hopper means can be moved relative to said stationary track.

14. Device as defined in claim 12, wherein said spaced walls of said hopper means extend below the ends of said spaced walls of said track, whereby the device may be rested on a surface on said hopper means spaced walls and said track can be moved relative to said stationary hopper means.

15. Device for dispensing equally sized planar cards having a predetermined thickness comprising hopper means having an open card-dispensing end, the internal dimensions of said hopper means substantially corresponding to the planar dimensions of the cards to permit a stack of cards to pass through said hopper means with clearance; an elongate track having a plurality of co-planar surfaces arranged in series along the length of said track and each of which has dimensions substantially equal to the dimensions of said dispensing end; guide means for guiding said hopper means for relative movement along said track to cause said dispensing end to register with successive ones of said surfaces, said guide means further maintaining said dispensing end spaced from said surfaces a distance approximately equal to said predetermined thickness and protuberance means between adjacent track surfaces and projecting beyond said surfaces a distance approximately equal to said predetermined thickness to define movement limiting means and, with associated surfaces, card-receiving means, whereby only the end card of a stack at said dispensing end can be received; each card-receiving means on said track when said housing is in opposition or in registry with the respective card-receiving means and the next successive card in the stack is thereby maintained at said dispensing end unitl said housing is brought into registry with the next successive card-receiving means; and further comprising stop means at the ends of said track for preventing movement of said hopper means off said track during reciprocal movements thereon, said track having an end planar surface at each end thereof proximate another one of said stop means, said stop means being arranged to stop said hopper means at each end of said track with said dispensing end substantially in alignment with a corresponding end planar surface.

16. Device for dispensing equally sized planar cards having a predetermined thickness comprising hopper means having an open card-dispensing end, the internal dimensions of said hopper means substantially corresponding to the planar dimensions of the cards to permit a stack of cards to pass to pass through said hopper means with clearance; an elongate track having a plurality of co-planar surfaces arranged in seris along the length of said track and each of which has dimensions substantially equal to the dimensions of said dispensing end; guide mans for guiding said hopper means for relative movement along said track to cause said dispensing end to register with successive ones of said surfaces, said guide means further maintaining said dispensing end spaced from said surface a distance approximately equal to said predetermined thickness and protuberance means between adjacent track surfaces and projecting beyond said surfaces a distance approximately equal to said predetermined thickness to define movement limiting means and, with associated surfaces, card-receiving means, whereby only the end card of a stack at said dispensing end can be received; each card-receiving means on said track when said housing is in opposition or in registry with the respective card-receiving means and the next successive card in the stack is thereby maintained at said dispensing end until said housing is brought into registry with the next successive card-receiving means, said track having first guide means extending along the length thereof, and said hopper means comprising skirt means disposed proximate to said track and provided with second guide means for matingly engaging said first guide means, said first and second guide means being maintained in engaged condition during relative movements of said track and said hopper means to thereby maintain the relative positions and orientations of said hopper means with respect to said track in all positions of the former on the latter.

* * * * *